US007040999B2

(12) United States Patent
Trainello

(10) Patent No.: US 7,040,999 B2
(45) Date of Patent: May 9, 2006

(54) SWIVEL OR ROTATING GOLF CLUB HEAD

(75) Inventor: Jerry Salvatore Trainello, Sarasota, FL (US)

(73) Assignee: Jerry S. Trainello, Taywater Dell Sarasota, FL (US)

( * ) Notice: Subject to any disclaimer, the term of this patent is extended or adjusted under 35 U.S.C. 154(b) by 0 days.

(21) Appl. No.: 10/614,579

(22) Filed: Jul. 7, 2003

(65) Prior Publication Data

US 2004/0248663 A1 Dec. 9, 2004

Related U.S. Application Data

(60) Provisional application No. 60/476,157, filed on Jun. 4, 2003.

(51) Int. Cl.
*A63B 69/36* (2006.01)
*A63B 53/02* (2006.01)
*A63B 53/04* (2006.01)

(52) U.S. Cl. ..... 473/238; 473/242; 473/251; 473/313; 473/340

(58) Field of Classification Search ..... 473/235–254, 473/305–315, 340–341, 325, 219, 231
See application file for complete search history.

(56) References Cited

U.S. PATENT DOCUMENTS

| | | | | | |
|---|---|---|---|---|---|
| 1,703,199 | A * | 2/1929 | McClure | 473/243 |
| 2,702,060 | A * | 2/1955 | Bonnesen | 81/22 |
| 3,042,405 | A * | 7/1962 | Solheim | 473/313 |
| 3,206,206 | A * | 9/1965 | Santosuosso | 473/248 |
| 4,073,492 | A * | 2/1978 | Taylor | 473/409 |
| 4,173,343 | A * | 11/1979 | Richilano | 473/251 |
| 5,390,920 | A * | 2/1995 | Nickum | 473/246 |
| 5,692,969 | A * | 12/1997 | Schooler | 473/313 |
| 2004/0142763 | A1 * | 7/2004 | Zarganis | 473/340 |

* cited by examiner

*Primary Examiner*—Sebastiano Passaniti
(74) *Attorney, Agent, or Firm*—Jerry Trainello

(57) ABSTRACT

A golf putter having a putter head that rotates when struck off-center by a golf ball includes a shaft that is centered on the putter head. The shaft and the putter head both include indicating lines that line-up and, upon the putter head being struck, will move out of alignment, with the amount of rotation visually showing the golfer where on the putter head the ball struck. The indicating lines are easily lined up again for the next putt.

1 Claim, 4 Drawing Sheets

SWIVEL OR ROTATING GOLF CLUB HEAD

CROSS-REFERENCE TO RELATED APPLICATIONS

This application claims the benefit of PPA Application No. 60/476,157 Filing Date Jun. 4, 2003

BACKGROUND OF THE INVENTION

1. Field of Invention

The present invention relates to the game of golf. Specifically to a moveable or rotating golf club head.

2. Prior Art

Golf clubs are well known to have a shaft, a club head, and a grip or method of holding the club. The club head also has a center or sweet spot, when hit the golfer has the best chance of keeping the golf ball on line to the target. The shaft and club head are rigid and work together as one piece.

Because of the importance of putting to scoring well in the game of golf, serious golfers spend a great deal of time practicing their putting stroke and thereby improve their score.

Applicant is aware of patented golf clubs and putters with adjustable shafts and club heads that move when adjusted by the golfer. These clubs seem to be very complex and include many working parts.

Such as U.S. Pat. No. 5,749,790, U.S. Pat. No. 5,692,969 and U.S. Pat. No. 4,815,740. In these patents the head of the golf club is adjustable relative to the shaft in a variety of ways to vary the angle or loft of the club head.

Applicant is not aware of any prior art that utilizes a uniquely configured practice golf club, with a club head that swivels or rotates upon being struck by a golf ball.

The club head is also configured via an indicator or indicia on the club head and shaft to visually indicate the amount of rotation the club head moves when the golf ball is hit off-center, the indicator is easily reset. With practice, the golfer will learn to strike the golf ball without moving the indicator off line, indicating a center hit.

Therefore it would be very desirable to have a training golf club or putter that is simple in construction and upon impact visually lets the golfer know if the golf shot or put is a center hit.

BRIEF SUMMARY OF THE INVENTION

The present invention is directed at the golfer who with proper practice wants to improve their swing and striking of the golf ball or put.

With the present invention, the golf club head will swivel or rotate 360 degrees around the golf club shaft. How much the club head rotates around the center axis of the shaft depends on how far off-center the golf ball is hit and how hard.

With the present invention, the golfer lines up the golf ball and swings or puts. If the golf ball is not struck in the center or sweet spot on the club head, the head will swivel or rotate and throw the golf ball and indicators off line in an exaggerated fashion making the golfer aware of a bad swing or put.

The opposite happens when a golf ball is hit in the center or sweet spot on the swivel club head. The club head will not move and the indicators will line up making the golfer aware of a properly struck ball. With practice the golfer can greatly improve their golf swing or putting stroke.

It is therefore an object of this invention to provide a practice golf club that a golfer can use indoors or outdoors and have fun while lowering their golf score.

It is another object of this invention to provide a practice golf club that on impact will visually show the golfer where the golf ball was struck on the club head by the movement of the head and indicators. It is yet another object of this invention to provide a training aid that looks, feels and handles like a conventional golf club.

In accordance with these and other objects that will become apparent, the swivel or rotating club head will now be described with reference to the accompanying drawings.

DRAWING—REFERENCE NUMERALS

12—golf club shaft 14—member 14*a*—houses golf shaft 14*b*—tapered piece 14*c*—pivot point 16—indicator etched on tapered piece 18—indicator etched on club head 20—club head or putter head 20*a*—front face 20*b*—rear face 20*c*—topside 20*d*—bottom side 20*e*—front 20*f*—backside 22—screw hole 24—pin or screw 26—bushing 28—bore or through-hole 30—screw 32—tension spring or slip clutch 34—golf ball

DESCRIPTION OF A PREFERRED EMBODIMENT

A swivel or pivotable putter head or golf club head according to preferred embodiments of the present invention is shown in FIGS. 1–9.

Figure 1:
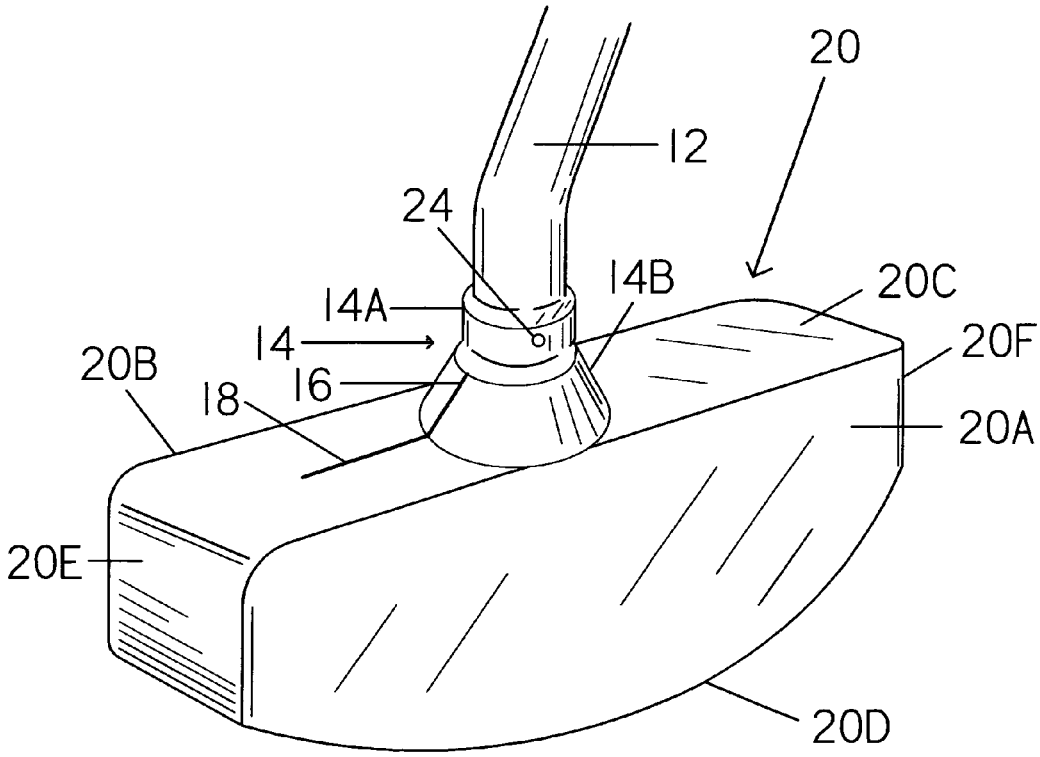
FIG. 1 is a right perspective view of a conventional golf putter modified in accordance with the concept of the present invention.

FIG. 1 12 is the pivotable putter head shaft that is approximately a 70-degree angle and of conventional length. The shaft is secured at the top end of rotatable member 14. The shaft may be made of any material a golf club shaft is made of including steel. Pivotable putter head 20 is comprised of a front face 20*a*, a rear face 20*b*, topside 20*c*, a bottom side 20*d*, a front 20*e* and a backside 20*f*. Pivotable putter head 20 also has a bore approximately center on topside 20*c*. Pivotable putter head 20 is pivotably or rotatably mounted and may be made of any material a golf club head is made of including aluminum. Front face 20*a* is the side of pivotable putter head 20 that a right hander strikes the ball with. Member 14 and connection point 14*a* is recessed the same outside diameter as shaft 12 and holds shaft 12 in place with pin or screw 24. Member 14 is an integral part of 14*a*, 14*b* and 14*c* shown in FIG. 5. Member 14 is rotatably disposed within the central portion of bore 28. Member 14 may be made of aluminum or any other suitable material. An indicator or indicia 16 is etched into tapered piece 14*b*. On the topside of 20*c* etched in the metal is indicator or indicia 18. FIG. 1 shows Indicator 16 and indicator 18 in-line, in this position, indicators 16 and 18 are in the ready to use position.

Figure 2:
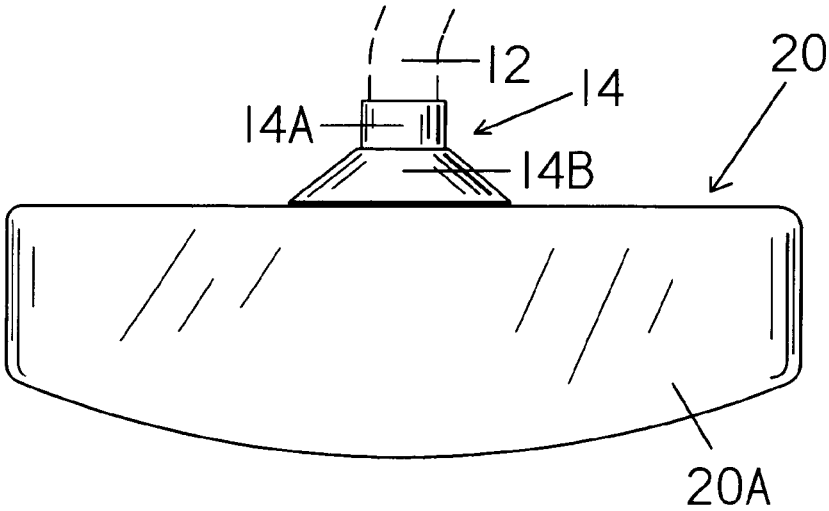
FIG. 2 is a right side view of FIG. 1.
Figure 3:
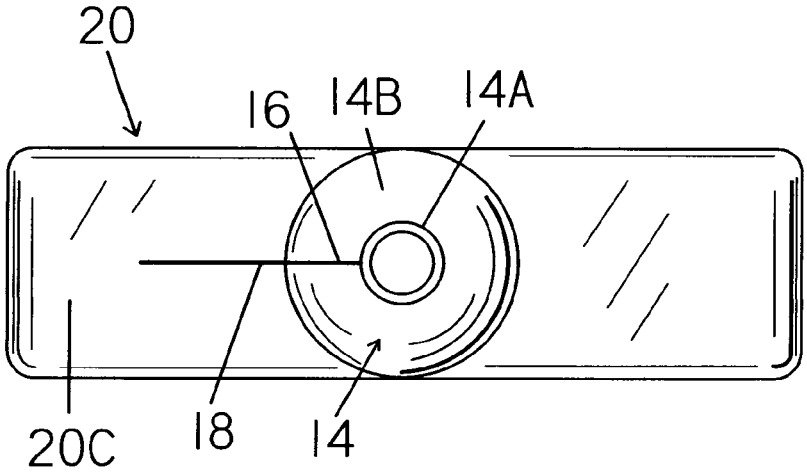
FIG. 3 is a top view of FIG. 1.
Figure 4:
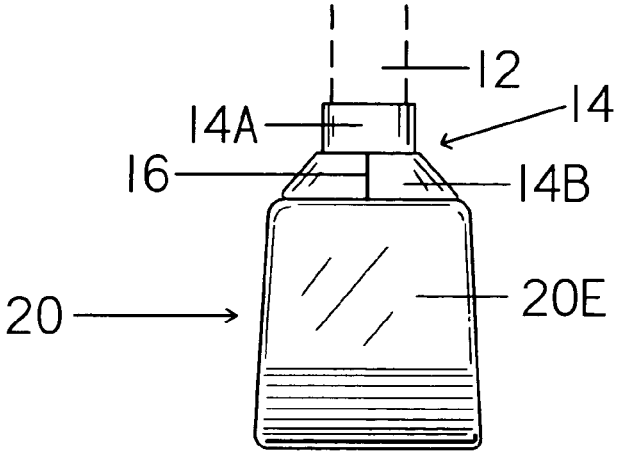
FIG. 4 is a front side view of FIG. 1.

Referring to FIG. 2, FIG. 3 and FIG. 4, showing three different views of pivotable putter head 20 modified according to the present invention. FIG. 2 is the front face 20*a*, FIG. 3 is the topside 20*c* and FIG. 4 is the front 20*e*.

Figure 5:
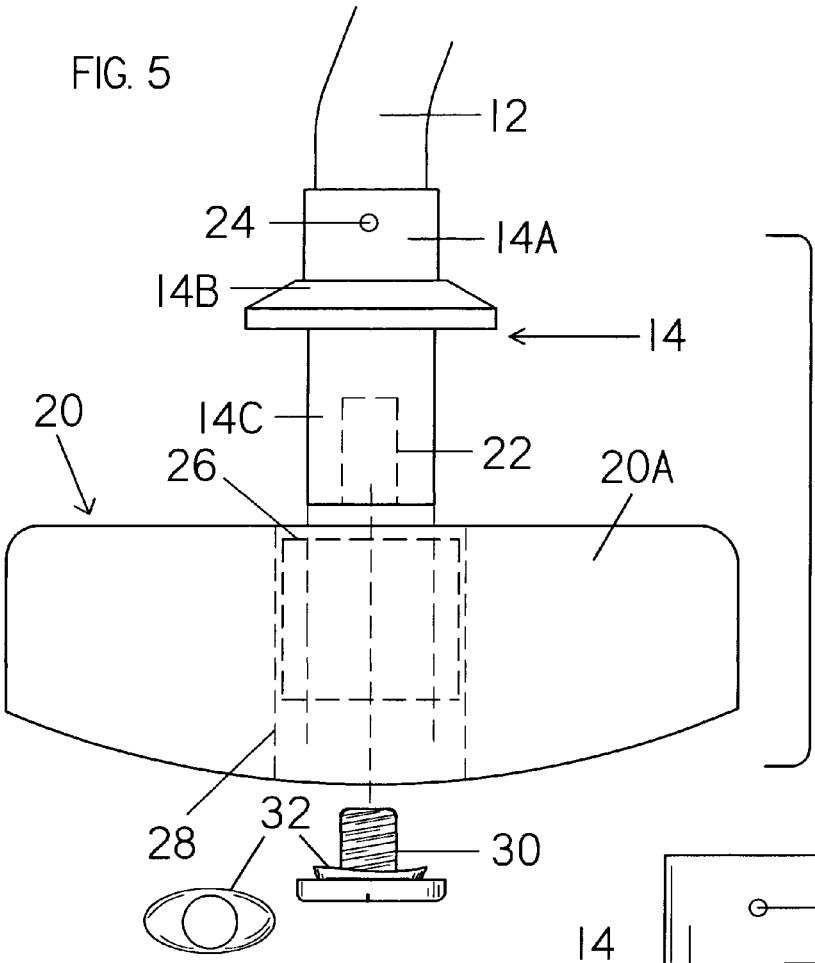
FIG. 5 is an exploded view of the golf putter in FIG. 1.

Pivotable putter head 20 of the embodiment shown in FIG. 5 an exploded view. FIG. 5 clearly shows pin or screw 24 holding shaft 12 in position and that member 14*a*, 14*b*, and 14*c* are of one piece of material. As can be seen, projection or pivot point 14*c* is rotatably disposed in bushing 26 and bore 28. The center hole of bushing 26 is of the size that it will rotate smoothly around pivot point 14*c*. Bushing 26 may be of bronze or any other suitable bearing material. Bushing 26 is a tight fit in bore or through-hole 28 and centered topside 20*c*.

At the bottom of member 14 pivot point 14*c* has an internally threaded hole 22 that may be threaded 10.32 for screw 30. Screw 30 may also have a compression spring or slip clutch 32 that fits over it to adjust the end-play and the amount of tension or drag on putter head 20. Member 14 is secured in place with 10.32 threaded screw 30.

Pivotable putter head 20 may be of any comfortable size or approximately 1.625 of an inch high by 4.5 inches long and 1.5 inches wide.

At the address position with the golfer gripping shaft 12 pivotable putter head 20 is able to rotate or pivot freely around the axis of golf shaft 12. Compression spring or tension spring 32 when tighten or loosened by screw 30 will regulate how freely putter head 20 will pivot or rotate on shaft 12. Ideally, putter head 20 should have a certain amount of lag, drag or friction and only move or swivel when being struck by a golf ball and not before.

Figure 6:
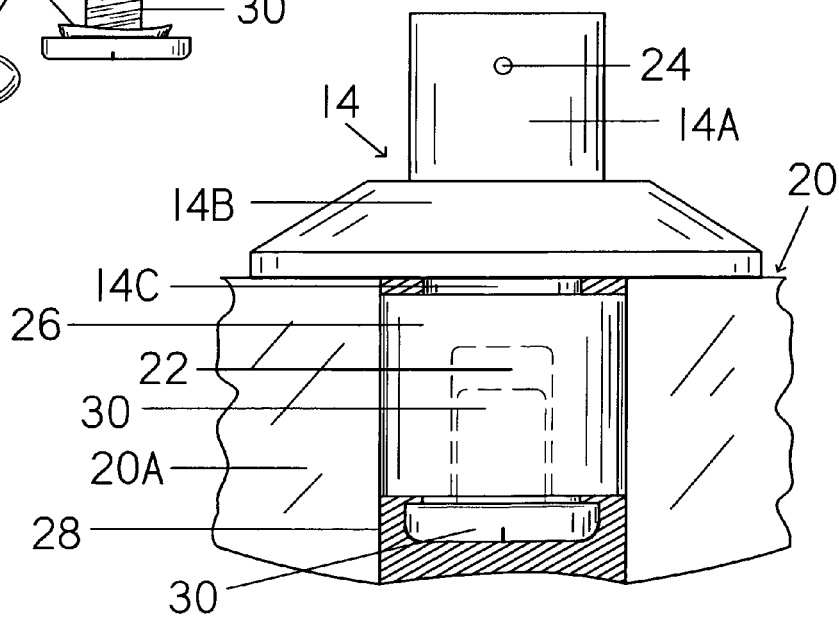
FIG. 6 is a sectional view of FIG. 5.

Again, as can be seen in FIG. 6 a sectional view. Pivot point or arbor 14*c* is in bushing 26 that is pressed into bore or through-hole 28. FIG. 6 also shows rotatable member 14 secured at the bottom end by screw 30.

Figure 7:
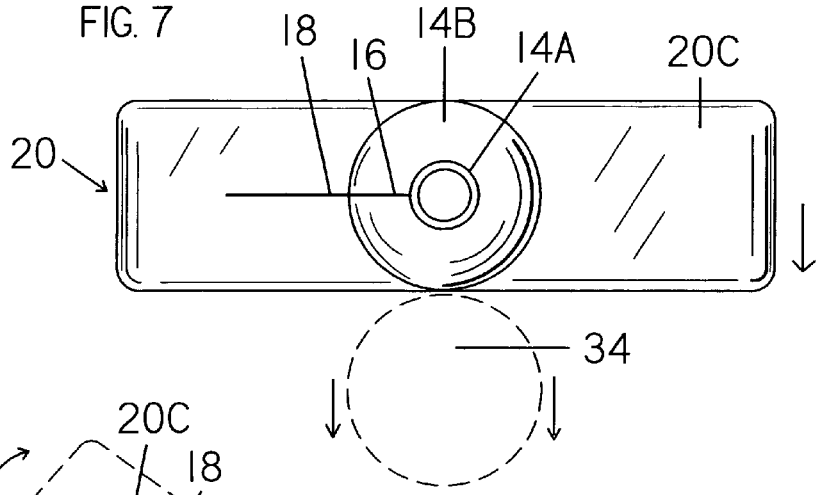
FIG. 7 is a top view of the putter striking the golf ball on-center.

As can be seen in FIG. 7, pivotable putter head 20 as seen from the top is striking golf ball 34 on-center. With a center hit bushing 26 will not swivel or rotate around pivot point 14*c*. Indicator 16 and 18 will not move and remain lined up.

Figure 8:
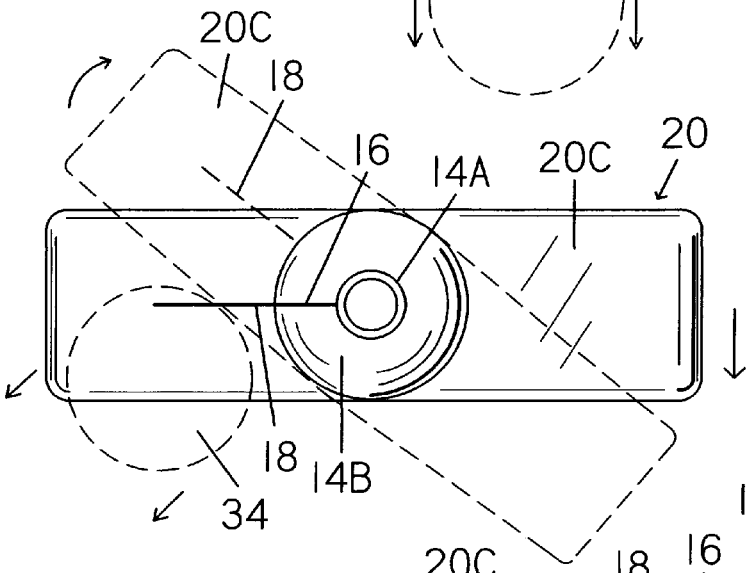
FIG. 8 is a top view of the putter striking the golf ball off-center left.
Figure 9:
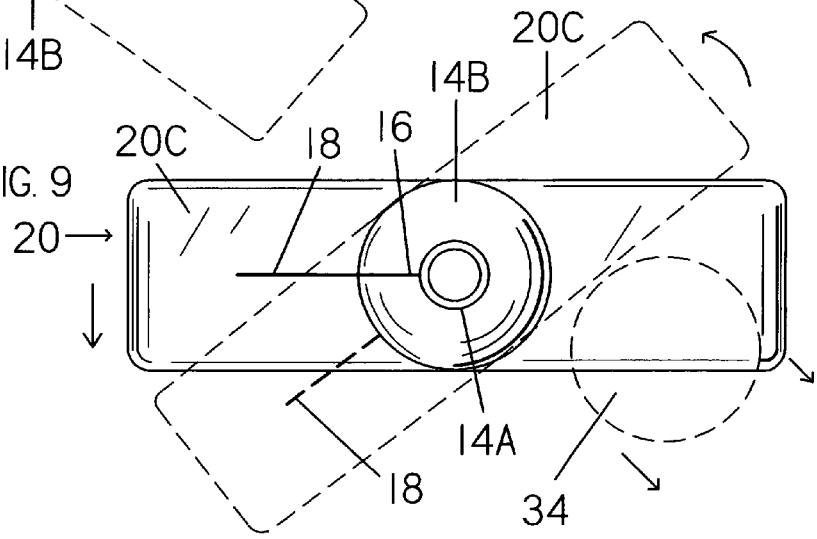
FIG. 9 is again a top view of the putter striking the golf ball off-center right.

As can be seen in FIG. 8 pivotable putter head 20 also a top view. In this position golf ball 34 is striking pivotable putter head 20 off-center left. The impact of the off-center hit causes bushing 26 and pivotable putter head 20 to rotate around pivot point 14*c*. When this occurs indicator 18 and pivotable putter head 20 move off indicator 16 in the direction of impact. Referring to FIG. 9 the opposite of FIG. 8 is occurring. Golf ball 34 is striking putter head 20 off-center right. Again bushing 26 moves or rotates around pivot point 14*c* from the off-center hit and impact of golf ball 34.

Again, indicator 18 moves but in the opposite direction of FIG. 8 taking pivotable putter head 20 with it.

CONCLUSION, RAMIFICATIONS, AND SCOPE

Accordingly, the reader will see there is a need for a golf putter or golf club that will help the serious golfer improve their feel on the putting greens as well as the golfers overall golf swing. The swivel or rotating putter and indicator will visually indicate after each shot whether the ball was struck on-center or off-center, giving the golfer instant information that will improve their golf game.

The swivel putter is as portable as any golf club, handles like a conventional golf club and gets results with very simple easy to manufacture mechanics.

In accordance with the provisions of the patent statutes, the present invention has been described in what is considered to represent its preferred embodiment. However, these should not be construed as limiting the scope of the invention but as merely providing illustrations of some of the presently preferred embodiments of this invention.

For example, the pivot point and working parts need not be in the head of the golf club. The arbor or pivot point and all the moving and non-moving parts can be in or on the shaft of the golf club with the same results. The bushing can be a ball bearing or any means that will permit the club head to move or rotate. The pivot point need not be an arbor, it can be a hinge or any other means that will cause a club head to move when hit off-center by a golf ball. The shape of the club head can be of a different design. In the preferred embodiment illustrated is a golf putter yet the concept of the swivel or rotating club head may be any golf club including a driver.

Thus the scope of the invention should be determined by the appended claims and their legal equivalents, rather then by the examples given.

I claim:

1. A putter comprising:

a putter head body having a front face, a rear face, a topside and a bottom and further including a shaft-receiving bore located substantially at the center of the topside of the putter head body and extending into the putter head body;

a shaft substantially centrally attached to the topside of the putter head; said shaft extending into the shaft-receiving bore within the putter head body;

pivotal means for joining said putter head body and said shaft such that the putter head body may rotate with respect to the shaft while the shaft is held substantially firmly in a golfer's hands during striking of a golf ball with the front face of the putter head body;

a tapered piece located on said shaft and adjacent to said top surface of said putter head body; said tapered piece including attaching means for attaching said tapered piece to said shaft; said tapered piece further including viewable indicia thereon;

whereby with the inclusion of said viewable indicia the amount of putter head body rotation that occurs when a golf ball is struck off-center enables a golfer to identify where the golf ball has struck the front face of the putter head body.

* * * * *